United States Patent [19]

Weldon

[11] Patent Number: 4,482,149

[45] Date of Patent: Nov. 13, 1984

[54] ARM EXERCISING DEVICE

[76] Inventor: David E. Weldon, 1010 Park Pl., Yreka, Calif. 96097

[21] Appl. No.: 504,989

[22] Filed: Aug. 8, 1983

Related U.S. Application Data

[63] Continuation of Ser. No. 284,587, Jul. 17, 1981, abandoned.

[51] Int. Cl.[3] ..... A63B 23/00

[52] U.S. Cl. ..... 272/67; 272/901

[58] Field of Search ..... 272/67, 68, 901, 142, 272/141

[56] References Cited

U.S. PATENT DOCUMENTS

| | | | |
|---|---|---|---|
| D. 237,634 | 11/1975 | Ricketts | 272/67 |
| 2,782,033 | 2/1957 | Ugartechea | 272/67 |
| 3,467,376 | 9/1969 | Feinberg | 272/67 |
| 3,662,602 | 5/1972 | Weiss | 272/DIG. 7 |
| 3,815,904 | 6/1974 | Weiss | 272/67 |
| 3,982,757 | 9/1976 | McDonnell | 272/67 |
| 4,157,179 | 6/1979 | Ecklor | 272/67 |
| 4,171,801 | 10/1979 | Bell | 272/67 |
| 4,343,465 | 8/1982 | Allen | 272/67 |
| 4,423,862 | 1/1984 | Hewitt | 272/67 |

*Primary Examiner*—Richard J. Johnson

*Attorney, Agent, or Firm*—Leonard D. Schappert

[57] ABSTRACT

An arm exercising device is provided having an exercising arm adjustable to different lengths to accommodate forearms of different lengths and attached to a bearing-supported lateral rod which has an upright portion at the other end.

Springs or other tension devices are attached at one end to the lateral rod and, at the other end, to a tension bar which is adjustable with respect to the base.

In one variation, the tension arm can be re-positioned 180 degrees from its initial position, thereby permitting use of the device for exercising right or left arms. In a further refinement, safety stops are provided which limit the movement of the exercising arm, thereby preventing it from passing the upright position.

1 Claim, 4 Drawing Figures

FIG. 1.
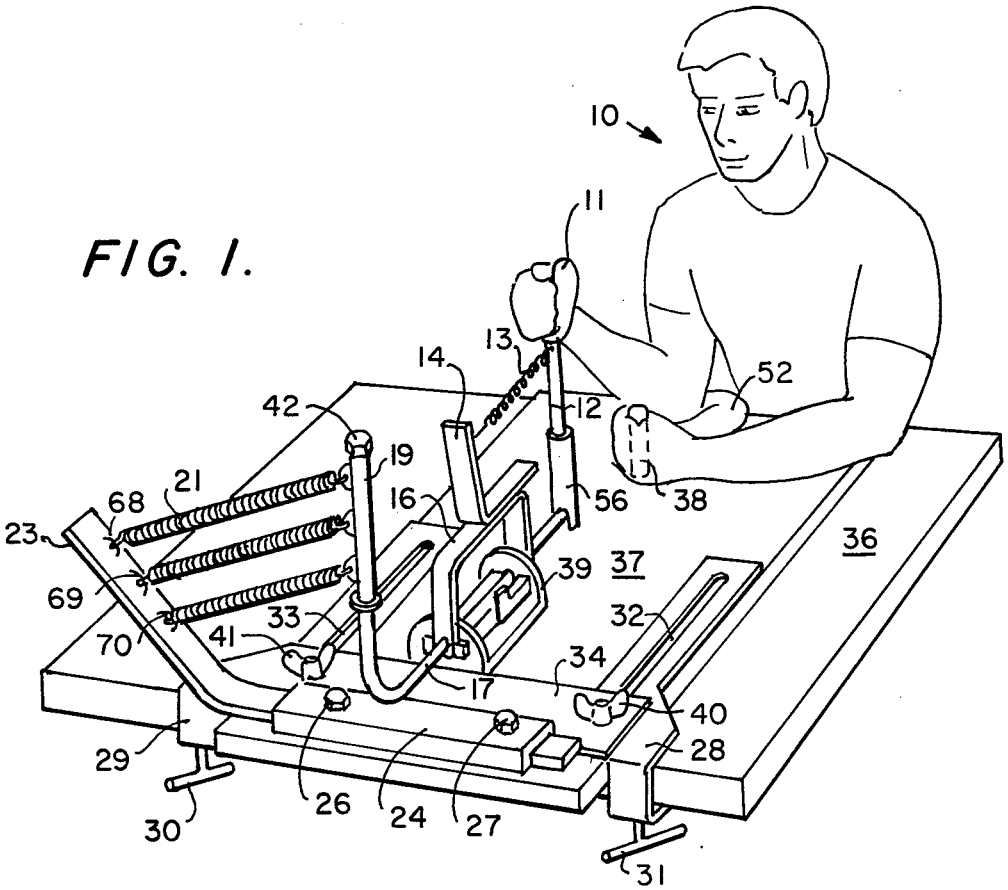
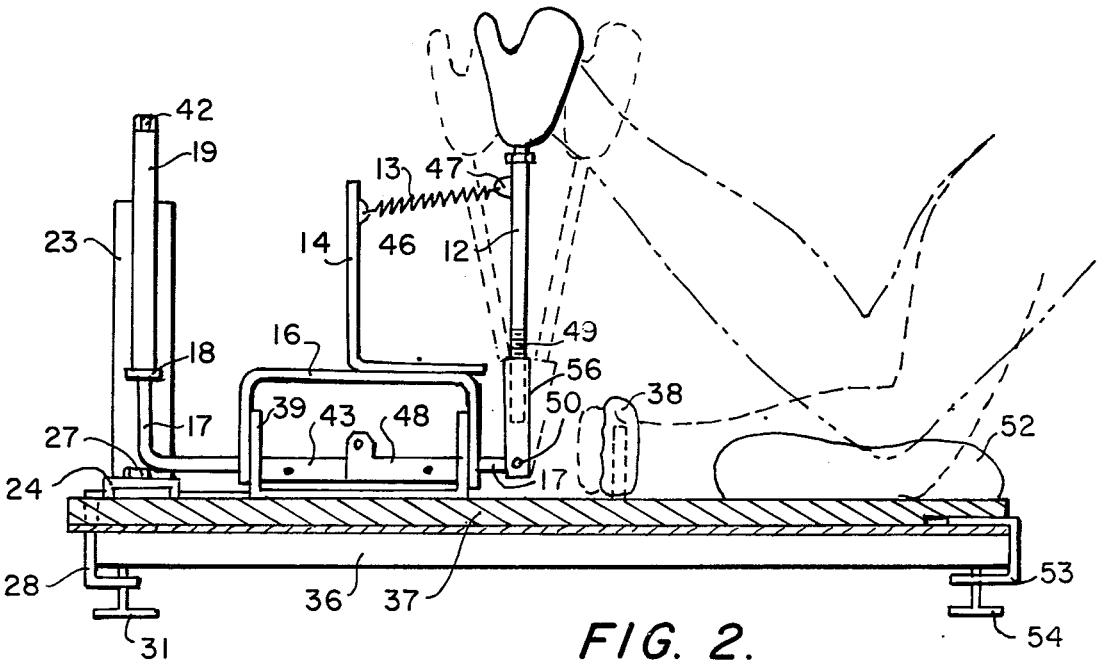
FIG. 2.

ARM EXERCISING DEVICE

This is a continuation of application Ser. No. 284,587, filed 7/17/81, now abandoned.

BACKGROUND OF THE INVENTION

1. Field of the Invention

The present invention relates generally to exercising apparatus, and more particularly to exercising apparatus suitable for exercising the arms, and which are adjustable to accommodate forearms of different lengths and arms of different strengths.

2. Description of the Prior Art

Numerous arm exercising devices are already known. However, typically, exercising equipment of this type does not provide for easy adjustment of the tensioning of the spring, nor does it approximate the positioning and movement of another person's arm. Specifically, there is no lateral flexibility, nor is there a swivel designed into the hand grip of the exercising arm.

For example, arm exercisers generally include hand grips and a plurality of metallic springs connected to the exercising hand grip. Such units are not easily adjustable, nor do they permit ease of adjustment from right to left arm in a device which approximates another human arm.

Prior art patents which may be pertinent to this application are U.S. Pat. Nos. 2,782,033; 3,815,904; 3,982,757; 4,157,179.

SUMMARY OF THE INVENTION

One of the objects of the present invention is to provide an arm exerciser which is relatively simple in construction and economical to manufacture.

Another object of the present invention is to provide an arm exercising apparatus which includes one hand grip for the arm being exercised and another hand grip for holding one's body in place while exercising.

Another object of the present invention is to provide an exercising apparatus which is easily adjustable in terms of tensioning.

A further object of the present invention is to provide an arm exerciser which, through mechanical means, simulates the flexiblity evident in another arm.

Another object of the present invention is to provide an arm exerciser which is safer than the exercisers heretofore existing in that the tensioning springs and any potentially dangerous portions of the exerciser are out and away from the arm of the person exercising.

Another object of the present invention is to provide an arm exerciser which includes safety stops which prevent the arm exerciser from pulling a weak arm past the vertical position.

In achieving the above objects, the present invention comprises a unit in which the exercising arm moves laterally as well as pivotally for purposes of approximating the movements of the arm of another person. Additionally, the present invention includes stops which, when set in place, are designed to prevent the unit from passing the vertical position with respect to either a left or a right arm. The present invention also includes multiple springs which are placed across the table from the person exercising, and which can be set to accommodate either a right-handed or a left-handed person.

These objectives, as well as other objectives of the present invention, will become obvious through the following discussion of the invention.

BRIEF DESCRIPTION OF THE DRAWINGS

FIG. 1 is a perspective view of the exercising device showing a person ready to begin exercising, and with the exercising arm (12) in the vertical position.

FIG. 2 is a side view highlighting the lateral movement of the exercising arm (12), noted earlier, and showing in more detail the adjustable hand grip (51) and the height adjustment involved in the exercising arm (12).

DESCRIPTION OF THE PREFERRED EMBODIMENT

Figure 3:
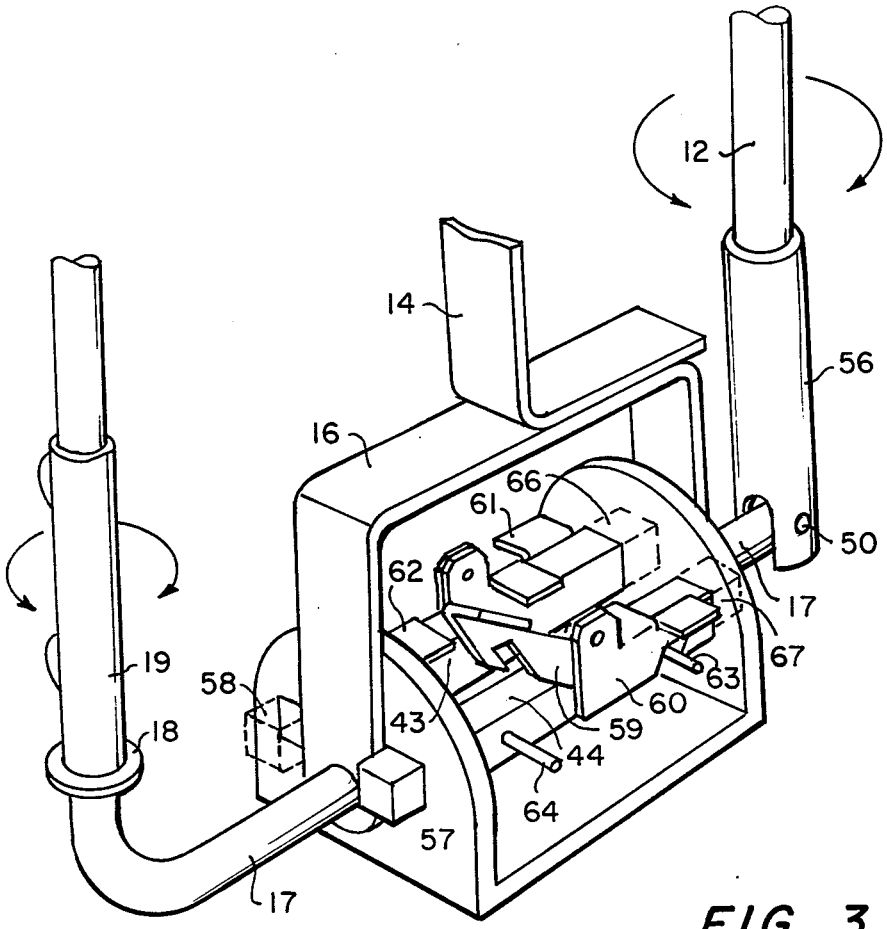
FIG. 3 is an expanded perspective view of the base portion of the exercising device showing the safety stops and the movable parts in more detail.

Going to FIG. 1, a perspective view of an arm exercising device is shown. The person (10) grips the grip (11) of the exercising arm (12) with the right hand and, at the same time with the left hand, grips the grip (38), resting the elbow of his right arm on pad (52), thereby permitting him to hold his body in position while exercising his right arm. As can be seen, the grip (11) swivels upon the exercising arm (12) of the unit. The exercising arm (12) is threaded, and screws into the hollow threaded rod (56), thereby permitting vertical adjustment of the exercizing arm (12). This permits adjustment of the height of the exercizing arm (12) to match forearms of different lengths. The hollow threaded rod (56) is pivotally connected with pin (50) to round rod (17). The round rod (17) passes through the bearing plate (39), turns up at a right angle, and passes through the hollow spring rod (19). The hollow spring rod (19) is held in place by the rod stop (18) and the retaining nut (42). Springs (20), (21) and (22) are connected to the round spring rod (18) through eyelets (71), (72) and (73). The other ends of springs (20), (21) and (22) are connected to the tension brace bar (23) through eyelets (68), (69) and (70). The tension brace bar (23) slides into the tension brace positioner (24) and is held in place by bolts (26) and (27). As can be seen from FIG. 1, the tension brace bar (23) is adjustable horizontally to increase or decrease the tension upon the round rod (17) by springs (20), (21) and (22). For purposes of adjusting the tension upon round rod (17), springs (20), (21) and (22) can be replaced with heavier or lighter springs, according to the desire of the person exercising.

The base (37) of the exercise machine is held in place on a table or desk by table clamp braces (28) and (29). These braces tighten against the table through the use of threaded keys (30) and (31). Additionally, the base (37) is adjustable with respect to the person (10) through the loosening or tightening of wing nuts (40) and (41), and sliding back and forth along the grooves (32) and (33) of the table clamp braces (28) and (29).

Going now to FIG. 2, a side view of the exerciser is shown. Here, the grip (11) and the exercising arm (12), in conjunction with the hollow threaded rod (56), are shown as being laterally pivotable. The upright position is shown in solid lines, and forward and backward position is shown in broken lines. This action approximates one of the movements of a wrestler's arm involved in arm wrestling. The exercising arm (12) is held in an upright position through the use of tension spring (13). Tension spring (13) is held in place by the use of an eyelet (47) attached to exercising arm (12) and an eyelet (46) attached to spring brace (14). Spring brace (14) is welded to iron brace (16). The exercising arm (12) is adjustable vertically through the use of a threaded portion (49) of the hollow threaded rod (56). Additionally, the pivotal connection (50) to round rod (17) is shown in more detail. The hand grip (38) is adjustable vertically with respect to the base (37) through the use of a threaded portion (51).

Additionally, the placement of the stop housing (43) and the stop release (60) is shown. This is shown in greater detail in FIG. 3.

Now going to FIG. 3, the base area of the exerciser is shown in much greater detail. The adjustable exercising arm (12) is shown with an arrow indicating the movement involved in adjusting it vertically within the hollow round rod (56). The pivotal connection (50) of the round rod (56) is shown upon pin (50) to rod (17). The spring-loaded stops (57), (58), (66) and (67) are shown in conjunction with stop housings (43) and (44). The stop housings (43) and (44) are welded to the bearing plate (39), and are slotted to permit the movement of the spring-loaded stops (57), (58), (66) and (67) by the use of pins (63) and (64). The spring-loaded stops (57), (58), (66) and (67) are lockable through the use of the stop releases (59), (60), (61) and (62). When the exercising unit is used to exercise the right arm, the stops (58) and (66) are released. When the unit is used to exercise the left arm, stops (58) and (66) are locked, and stops (57) and (67) are released.

Figure 4:
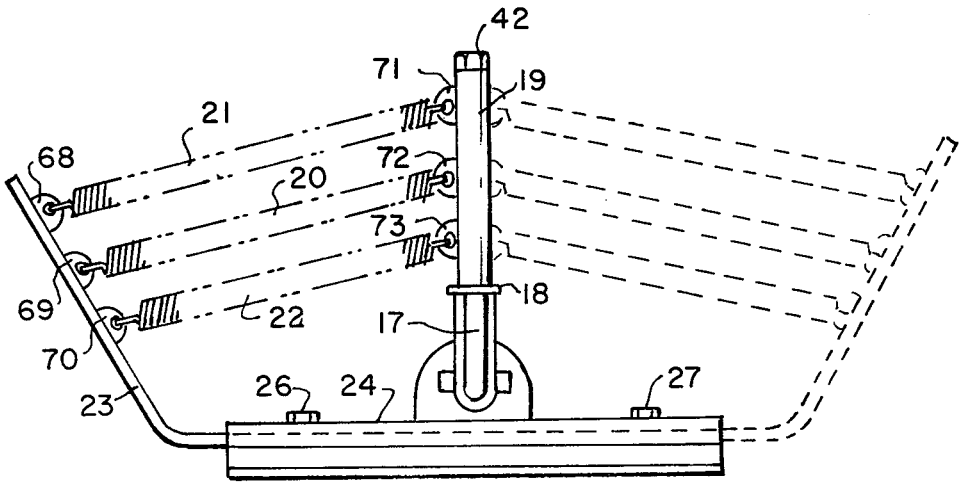
FIG. 4 is an end view of the far sides of the exercising device showing the positioning of the springs when the unit is in use by a right-handed exerciser, and showing in broken lines the position of the springs when the unit is in use by a left-handed exerciser.

Now going to FIG. 4, an end view of the tensioning portion of the arm exercise unit is shown. This view shows in greater detail the attachment of springs (20), (21) and (22) through eyelets (71), (72) and (73) on the round hollow rod (19), and through eyelets (68), (69) and (70) on the tension brace bar (23). This view further shows the tightening screws (26) and (27) which hold the tension brace bar (23) in place within the tension brace positioner (24). The solid lines show the springs (20), (21) and (22) in position for use by a right-handed person. To modify the unit for use by a left-handed person, the bolts (26) and (27) are loosened, the tension brace bar (23) is pushed farther into the tension brace positioner (24), nut (42) is removed, and the round hollow rod (19) is slipped off of the round rod (17). The tension brace bar (23) is then removed from the tension brace positioner (24), and is inserted into the other end of the tension brace positioner (24), as shown by the broken lines. The round hollow rod (19) is replaced upon the round rod (17), and the nut (42) is replaced. The tension of springs (20), (21) and (22) is then adjusted through the use of bolts (26) and (27) in the tension brace positioner (24). After this is done and the stops as shown in FIG. 3 are set properly, the unit is ready for use by a left-handed person.

The foregoing description has been of a preferred embodiment only and, as numerous alterations of the structure herein described suggest themselves to those skilled in the art, it is to be understood that it is the intent of applicant that the description of the preferred embodiment is for purposes of illustration only, and is not to be construed as a limitation of the scope of applicant's invention and, further, that all suitable modifications and equivalents which fall within the scope of the following claims are meant to be protected under this patent.

I claim:

1. An arm exercising device comprising:

a base;

means for attaching said base to a surface;

bearing means mounted upon said base;

a round rod supported by said bearing means on a substantially horizontal axis, having a first end and a second end offset from said first end;

a tension arm rigidly attached to said first end of said round rod and extending substantially perpendicularly with respect to said horizontal axis;

tension bar means attached to said base by lateral adjustment means;

first tension means connected between said tension arm and said tension bar means so that tension can be increased or decreased throughout a given range through lateral adjustment of said tension bar means with respect to said base;

an exercise arm having a first end and a second end, said first end being pivotally attached by pivot means to said second end of said round rod on an axis substantially perpendicular to said horizontal axis;

a first hand grip rotatably attached to said second end of said exercise arm;

means for adjusting the length of said exercise arm to match forearms of different lengths;

second tension means connected between said exercise arm and said round rod so that tension is created when said exercise arm is pivoted away from said second end of said round rod;

a second hand grip attached to and perpendicular to said base, and spring-loaded safety stop means which, when engaged, hold said exercise arm in a position substantially perpendicular to said horizontal axis.

* * * * *